US006374550B1

(12) United States Patent
Reus

(10) Patent No.: US 6,374,550 B1
(45) Date of Patent: Apr. 23, 2002

(54) RIGID DWELLING HOUSE, A SWIMMING POOL, AND MEANS TO MOVE THE HOUSE ATOP THE POOL

(76) Inventor: Brigitte Reus, 24 Rue de la PY, F-75020 Paris (FR)

( * ) Notice: Subject to any disclaimer, the term of this patent is extended or adjusted under 35 U.S.C. 154(b) by 0 days.

(21) Appl. No.: 09/630,274

(22) Filed: Aug. 1, 2000

(51) Int. Cl.[7] ..... E04B 1/346
(52) U.S. Cl. ..... 52/64; 52/90.1
(58) Field of Search ..... 52/64, 90.1, 29, 52/DIG. 14, 143

(56) References Cited

U.S. PATENT DOCUMENTS 4,288,949 A * 9/1981 Latimer ..... 52/67
4,426,744 A * 1/1984 Love ..... 4/503
5,546,972 A * 8/1996 Wardell et al. ..... 135/129

* cited by examiner

*Primary Examiner*—Carl D. Friedman
*Assistant Examiner*—N. Slack
(74) *Attorney, Agent, or Firm*—Brezina & Ehrlich

(57) ABSTRACT

A building includes a rigid dwelling-house enclosing an inner space, a swimming-pool, and a device for moving the dwelling-house relative to the swimming-pool between a first position in which the dwelling-house is positioned on top of the swimming-pool which is thereby incorporated within the inner space of the dwelling-house, and a second position in which the dwelling house is adjacent the swimming-pool. The swimming-pool is usable as an outdoor swimming-pool or a covered swimming-pool, each of the dwelling-house and the swimming-pool retaining a separate functionality and being usable separately and simultaneously.

12 Claims, 1 Drawing Sheet

*FIG. 1*
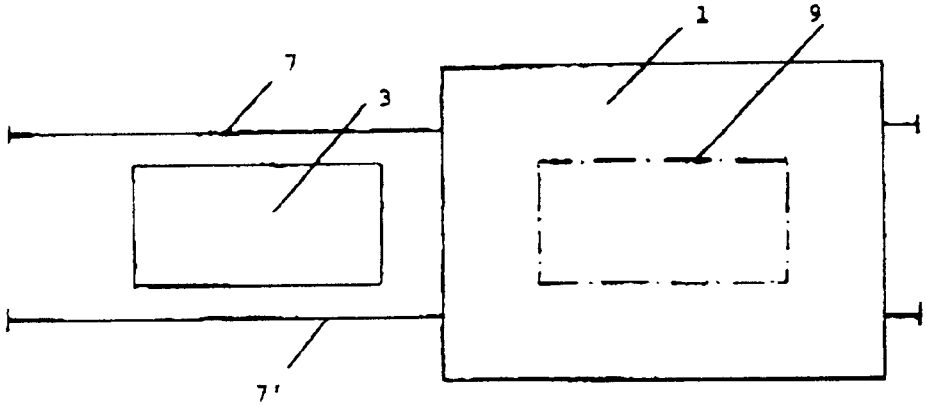
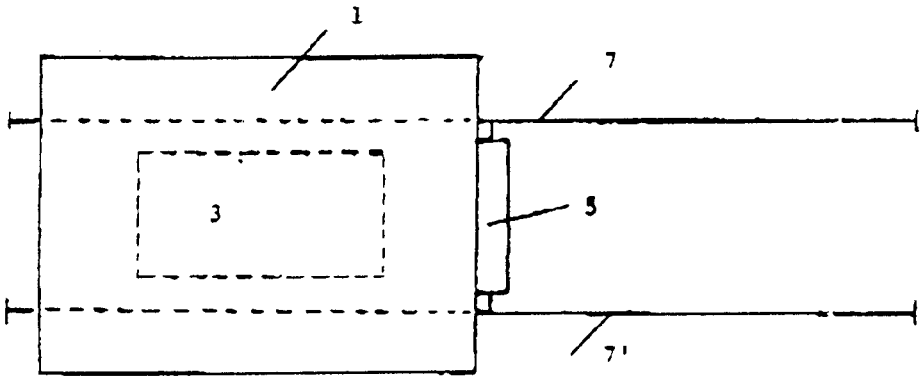
*FIG. 2*
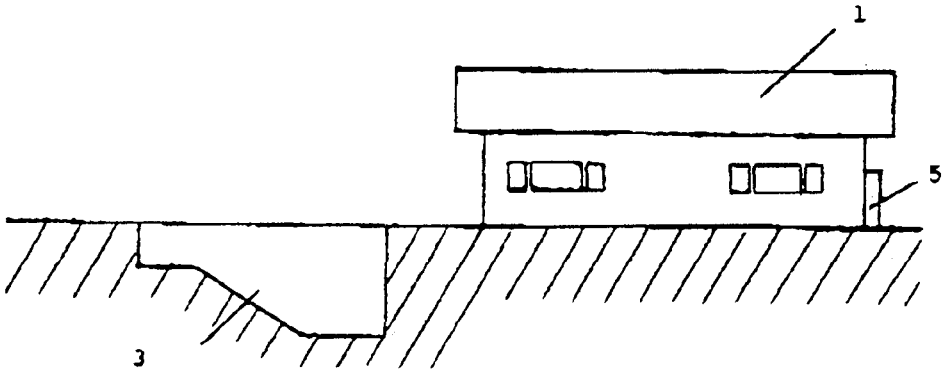
*FIG. 3*

RIGID DWELLING HOUSE, A SWIMMING POOL, AND MEANS TO MOVE THE HOUSE ATOP THE POOL

BACKGROUND OF THE INVENTION

The present invention relates to a building the use of which is essentially one of a dwelling-house and which is combined with a convertible swimming-pool, preferably of sunken type.

In temperate areas, users often wish to have an outdoor swimming-pool available in summer. In the interim season, weather conditions make it necessary to cover the swimming-pool and consequently several solutions have been offered.

The simplest, but often less convenient solutions consist in covering the swimming-pool water with coverings, tilts, floating covers or light shelters. Such elements essentially contribute to avoid heat losses, to protect from leaf falls and so on, but are to be folded each time the swimming-pool is to be used and to be subsequently spread, usually in the evening. The swimming-pool is generally emptied in winter time and remains unused.

The possibility to use a removable cover is described in patent FR-2,097,559 A and a design of a swimming-pool and an outbuilding adapted for ancillary equipment is proposed. This building is constructed lengthwise on the length of one side of the swimming-pool and supports guide rails perpendicular to said side of the swimming-pool positioned at the roof ridge. This allows to shift a light movable structure made of four adjacent sides using rollers or castors.

The movable structure is formed with a light frame, in aluminum for instance, and with translucent panels. A lower guide rail is also provided for this movable structure.

A movable pergola type shelter for use with a swimming-pool is provided in patent FR-2,708,957 A, which is mounted on castors so as to move it. It includes a rigid structure provided with a removable part at the ends thereof.

In DE-2,935,427 A, and EP-0,172770 A a cover for swimming-pools is disclosed, consisting in at least two rolling telescopically movable shelters.

These building types, which are by nature of a light type and essentially used as a cover, allows only indeed the swimming-pool to be partially used. In summer, the swimming-pool will be uncovered and in the interim season, it will be used in a closed position. However, in winter time, if weather is somewhat harsh, it will not be usable as it is insufficiently insulated by nature.

U.S. Pat. No. 4,288,949 A discloses a building of a telescopic type for a garage.

FR-2,526,469 A discloses a shelter for an automotive vehicle that rests on the same principle.

U.S. Pat. No. 5,168,675 describes a transportable manufactured building structure (mobile home etc) which can be moved via road travel which includes an interior incorporated pool or tub.

SUMMARY OF THE INVENTION

The invention aims at overcoming the disadvantages of the solutions offered in the state of art and more particularly at providing a solution that also allows using the swimming-pool in winter without requiring a specific covering unit exclusively designed for that use.

According to the present invention, a building for use as a dwelling-house including a swimming-pool which is convertible, so that it can be used both as an outdoor swimming-pool in summer and as a covered swimming-pool in winter, wherein a first part of the building for use as a dwelling-house is rigid and can be moved to be brought in winter on top of a second part which forms the swimming-pool so as to incorporate it within the inner space of said building, and can be moved in summer beside the swimming-pool to use it as an uncovered swimming-pool, wherein said first part of the rigid building used as a dwelling-house and said second part forming the swimming-pool are combined by means of a device allowing movement of the said first part of the building relative to the said second part, each of these parts namely dwelling-house and swimming-pool retaining its own function and being able to be used separately or simultaneously.

The above-mentioned moving device includes advantageously two rolling paths, preferably two rails, positioned on either side of the swimming-pool and parallel one to each other. These two rolling paths lie on a distribution bed-plate or any other appropriate foundation that allows for stress transmission to the ground.

The movement is performed by using any appropriate means, such as rolls, rollers or sliding shoes, in fluorinated polymer for example.

Any pushing or drawing system can be used in order to provide movement, more particularly from pushing jacks, cable jacks or a rack-gearing.

Numerous devices allowing the occasional movement of houses already exist. The proposed description of the moving device is in no way limitative, any device allowing the rigid structure making up the building to be moved from its summer position into its winter position or conversely, can be contemplated, the feature thereof being that it is no longer an occasional device but a permanent device of the building.

The building for use as a dwelling-house is a rigid structure which can be made with wood, metal, concrete, stones or any combination of these materials. The basic principle to be observed is that a rigid structure built for this purpose or alternatively an already existing rigid structure which will be previously provided with all the appropriate means allowing the movement thereof should be available.

The building is in no way limited in its shape, which can be for instance rectangular or square, the limitation being that of a bearing structure present which is adapted to support the whole building while moving.

The dwelling-house arrangement is conventional with its floor, said floor however including a recess or reserved location at least equivalent to the size of the swimming-pool and to-the optional surroundings thereof. In the winter position, the junction between the swimming-pool and the surroundings on the one hand and the floor of the dwelling-house on the other hand is made in such a way as to incorporate the swimming-pool into the indoor environment. Accordingly, this allows the swimming-pool to be used in winter, making use of the additional equipment provided in the dwelling part (for example sauna, spa, lavatories, locker room, etc.) taking advantage of the thermic insulation normally provided for any space used as a dwelling-house.

According to the invention, a lifting mechanism such as hydraulic jacks may be provided, e.g. on the rolls used for the displacement and allowing to raise the house for a few centimeters for allowing its displacement. Around the contour of the recess in the floor in the house and flush with said floor an insulating ribbon may be provided and/or a similar insulation ribbon may be provided around the pool so that when lowering the house after displacement, a good isolation of the house is obtained.

In the summer position (but as well in the winter position) the space of the recess in the dwelling-house floor may be treated in different ways.

A movable structure (optionally completed by a thermal insulation) can be consequently provided filling the recess. This structure acts as a flooring for the house and is preferably in harmony with the floor of the house where the recess is provided.

It is also to be envisaged that the ground under the house, becoming apparent in summer position, includes a permanent inner floor, such as pavement or tiling, and that the arrangement is completed with additional decorative elements.

It should be noted that the principle being disclosed is also compatible with possible level differences that can exist for the swimming-pool part and for the location provided for the building, in an uncovered swimming-pool position.

In some cases, such level differences can further be advantageously used to obtain innovative architecture concepts. The building design itself is that of a building for use as a dwelling-house, this term should be however used in a wide sense to include uses of sports hall, gymnasium, covered tennis-ground and other types. The ancillary devices for the swimming-pool are preferably incorporated into the building, without however excluding the possibility to securing them permanently, i.e. as a permanent station aside or near the swimming-pool. However, in principle, the advantage of the solution being offered lies in that a large part of the facilities within the building (such as lavatories, locker room, water, sewage and heating treatment systems) can be used.

In order to allow for the movement of the dwelling part, the connections with the utilities, such as electricity, water, sewers, etc. can be either removable or flexible.

The invention will be more fully described based on a preferred embodiment of the invention referring to the accompanying drawings, only given by way of an illustration of the principle design being implemented.

BRIEF DESCRIPTION OF THE DRAWINGS

FIG. 1 shows a schematic view in top elevation of a swimming-pool in a so-called summer position, i.e. with the swimming-pool in a outdoor position.

FIG. 2 illustrates a corresponding view with that of FIG. 1 in a so-called winter position, i.e. with the dwelling-house covering the swimming-pool.

FIG. 3 is a profile view corresponding to FIG. 1.

Identical reference numerals for the same components are used in the different figures.

DESCRIPTION OF A PREFERRED EMBODIMENT OF THE INVENTION

According to the invention, a mobile building 1 for use as a dwelling-house is combined with a swimming-pool 3 of sunken type, i.e. a pool received in an excavation in the ground through a moving device, designated schematically under the general numerals. Movement between the position of FIG. 1 and of FIG. 2 is made possible by paths illustrated in the form of two rails 7 and 7', positioned parallel on either sides of the swimming-pool and extending under the dwelling-house 1 in the winter position.

The pavement or tiling of the first floor of the dwelling unit includes a recess i.e. an open space or hole illustrated in dots and dashes lines 9 of a sufficient size to match at least the surface of the swimming-pool and optionally of its surroundings.

In the summer position, said recess can be covered with removable floor elements such as beams, joists or girders.

This building principle is understood to provide a large freedom in the selection of dimensions, of course within reasonable limits, and the shapes of both the swimming-pool (3) and the dwelling-house (1).

Although an embodiment has been described by way of an example, it should be understood that numerous additional modifications are possible within the scope of the invention.

Thus, the swimming-pool can be not sunken or only partially sunken. In that case, the part used as a dwelling-house may be provided with, for example, a removable door of garage door type which is closed when the dwelling-house, after being moved, has been brought to the swimming-pool covering position.

Depending among others upon the ground, slopes and level differences optionally present may be advantageously used, by means of appropriate arrangements.

What I claim is:

1. A building comprising:

a rigid dwelling-house enclosing an inner space;

a swimming-pool; and means for moving the dwelling-house relative to the swimming-pool between a first position in which the dwelling-house is positioned on top of the swimming-pool which is thereby incorporated within the inner space of the dwelling-house, and a second position in which the dwelling house is adjacent the swimming-pool, whereby the swimming-pool is usable as an outdoor swimming-pool or a covered swimming-pool, each of the dwelling-house and the swimming-pool retaining a separate functionality and being usable separately and simultaneously.

2. A building according to claim 1, wherein said mans for moving includes two rolling paths.

3. A building according to claim 1, wherein said means for moving includes two parallel rails positioned on opposite sides of the swimming-pool.

4. A building according to claim 1, wherein said means for moving includes rolling paths which are arranged on a foundation or distribution bed-plate that ensures stress transmission to ground.

5. A building according claim 1, wherein said means for moving includes rolls, rollers or sliding shoes for moving the dwelling-house relative to the swimming-pool.

6. A building according to claim 1, wherein said means for moving includes pushing and/or drawing devices for moving the dwelling-house relative to the swimming-pool.

7. A building according to claim 1, wherein the rigid dwelling-house comprises an already existing building which is permanently provided with said means for moving.

8. A building according to claim 1, wherein said dwelling-house comprises a floor including a recess at least equivalent in size to the swimming pool and a temporary structure to cover the recess comprising thermal insulation.

9. A building according to claim 1, wherein ground under the dwelling-house has a permanent inner floor pavement.

10. A building according to claim 1 wherein ancillary devices for the swimming-poll are incorporated into the dwelling house.

11. A building according to claim 1, wherein the dwelling-house comprises utility connections which are removable and/or flexible.

12. A building according to claim 1 wherein the means for moving comprises a lift mechanism for raising the house, and the dwelling-house and swimming-pool each comprise a-peripheral insulating ribbon which mate with each other to provide an insulating seal when the dwelling-house is lowered on top of the swimming-pool.

* * * * *